US009266364B2

(12) United States Patent
Suriol et al.

(10) Patent No.: US 9,266,364 B2
(45) Date of Patent: Feb. 23, 2016

(54) PRINTING ASSOCIATED PLOTS IN REGISTRATION

(75) Inventors: Selma Casanovas Suriol, Sant Cugat del Valles (ES); Michel Georges Encrenaz, Rubi Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 825 days.

(21) Appl. No.: 13/193,703

(22) Filed: Jul. 29, 2011

(65) Prior Publication Data

US 2013/0025488 A1 Jan. 31, 2013

(51) Int. Cl.
*B41F 1/34* (2006.01)
*B41J 11/46* (2006.01)
*B41J 3/60* (2006.01)

(52) U.S. Cl.
CPC ... *B41J 11/46* (2013.01); *B41J 3/60* (2013.01)

(58) Field of Classification Search
CPC ..... B65H 23/032; B65H 2701/1241; B65H 2701/12411; B65H 2301/5111; B41J 11/46; B41J 3/60
USPC ..... 101/486, 481; 399/394, 384; 400/583, 400/611
See application file for complete search history.

(56) References Cited

U.S. PATENT DOCUMENTS

| | | | | |
|---|---|---|---|---|
| 5,740,428 | A * | 4/1998 | Mortimore et al. | |
| 7,552,995 | B2 | 6/2009 | Nakazawa et al. | |
| 7,878,617 | B2 | 2/2011 | Mizes et al. | |
| 2008/0019727 | A1 * | 1/2008 | Honma | 399/82 |
| 2008/0260411 | A1 * | 10/2008 | Ariizumi | 399/72 |
| 2010/0073717 | A1 | 3/2010 | Debaere | |
| 2010/0329739 | A1 | 12/2010 | Pitas et al. | |

FOREIGN PATENT DOCUMENTS

KR 100576977 B1 8/2006

* cited by examiner

*Primary Examiner* — Matthew G Marini
(74) *Attorney, Agent, or Firm* — HP Inc. Patent Department

(57) ABSTRACT

In one example, a print job is received. The print job includes a first plot to be printed on a first side of a media, and a second plot to be printed on a second side of the media in registration with the first plot. The first plot and a fiducial mark are caused to print on the first side, the fiducial mark being a known distance from the first plot and including an identifier for the second plot. In response to detecting the identifier via a sensor and measuring a distance to the fiducial mark to discern a reference for printing the second plot, the second plot is caused to print on the second side in registration with the first plot.

20 Claims, 8 Drawing Sheets

PRINTING ASSOCIATED PLOTS IN REGISTRATION

BACKGROUND

In certain printing environments, it is desired to print a first series of plots upon a first side of a media, and an associated second series of plots onto a second side of the media such that the first series is in registration with the second series. For example, when printing a two-sided banner at a large format printer, the print job may include printing a first series of plots on the front side of the banner, and a second series of associated plots on the back side of the banner, with the goal that the plots on the front and back sides are properly matched and precisely aligned.

BRIEF DESCRIPTION OF THE DRAWINGS

The accompanying drawings illustrate various embodiments and are a part of the specification. The illustrated embodiments are examples and do not limit the scope of the claims. Throughout the drawings, identical reference numbers designate similar, but not necessarily identical elements.

The same part numbers designate the same or similar parts throughout the figures.

DETAILED DESCRIPTION OF EMBODIMENTS

Figure 1:
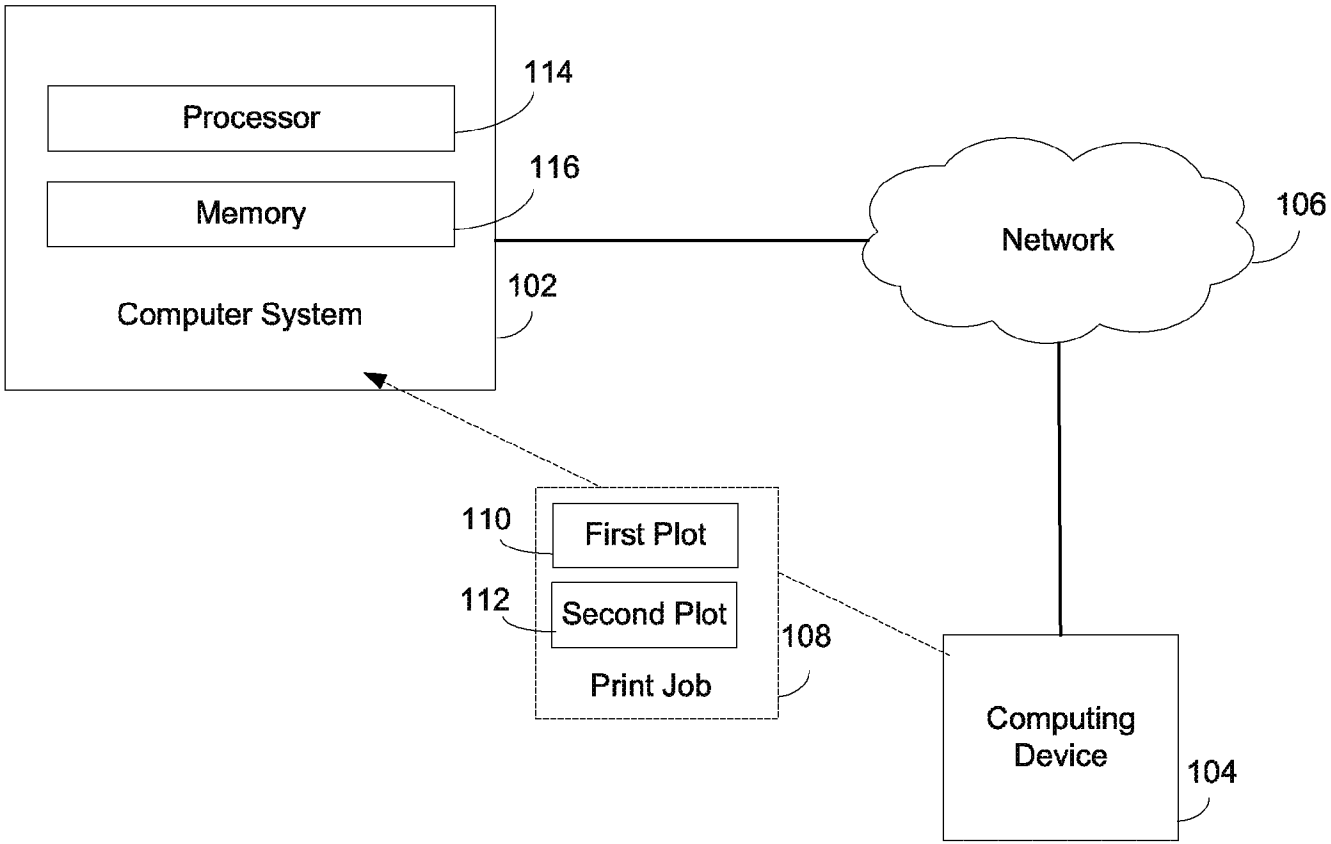
FIGS. 1 and 2 are block diagrams illustrating systems according to various embodiments.

Positioning of plots to be printed on a first side of a media ("first-side plots") and associated plots to be printed on the second side ("second-side plots") is commonly calculated as part of the raster image processing of a print job. However, despite proper raster image processing first and second side plots may sometimes be printed out of registration due to a number of subsequent factors. For example, interruption of a two-sided print job (e.g., due to a loss of power, a media jam, or a user cancelling the print job) can result in first-side and second-side images being mismatched or otherwise printed out of registration when printing resumes. Further, first and second side images may be printed out of registration due to media skew, media deformation, and/or other factors. When first and second side plots are not printed substantially in registration, the printed job can be perceived as being of poor quality and unacceptable to a user. Such association and registration errors can be costly as they may result in wastes of media, consumables (e.g., ink or toner), machine time and/or user time.

Accordingly, various embodiments described herein were developed in an effort to improve printing of associated plots in registration on first and second sides of a media, thus leading to reductions in waste, better ease of use of large format two-sided printers, and a better customer experience.

In an embodiment, a print job is received, the print job including a first plot to be printed the first side of a media, and an associated second plot to be printed on the second side of the media in registration with the first plot. The first plot and a fiducial are caused to be printed on the first side of the media, the fiducial a known distance from the first plot and including an identifier for the second plot. In response to a detecting of the identifier via a sensor, and a measuring of a distance to the fiducial to discern a reference for printing the second plot, the second plot is caused to print on the second side of the media in registration with the first plot. Advantages of the various embodiments disclosed herein include increases in the quality and accuracy of two-sided printing, and cost savings from decreased waste of media, consumables (e.g., ink or toner), machine time and user time.

As used herein, a "print job" refers to instructions and/or content for printing that can be stored in a programming language and/or numerical form so that it can stored and used in computing devices, servers, printers and other machines capable of performing calculations and manipulating data. A print job may include one or more plots. A "plot" is used synonymously with an "image", and refers to a representation or rendering of an object, scene, person, or an abstraction such text or a geometric shape. A first plot is referred to as being "associated" with a second plot if the two plots are intended to be printed on opposite sides of a media and in registration with each other. A first plot is referred to as being printed "in registration" with a second plot if the printed plots are properly aligned, placed and/or oriented relative to each other as specified in a print job. "Media" and "print media" are used synonymously and may include a continuous roll or web, sheets, or any other article or object on which a printed image can be formed. A "printer" refers to any electronic device that prints and includes multifunctional electronic devices that perform additional functions such as scanning and/or copying. A "fiducial" refers to a rectangle, an oval, a line segment, dot, spot, cross, or other geometrical shape or other visual feature that may be placed in the focal plane of a sensor and used as a reference point for measuring. An "identifier" for a plot refers to data, information, an object, abstraction or other thing that identifies, indicates, names or refers to the plot.

FIG. 1 is a block diagram illustrating a system according to various embodiments. FIG. 1 includes particular components, modules, etc., according to various embodiments. However, in different embodiments, more, fewer, and/or other components, modules, arrangements of components/modules, etc., may be used according to the teachings described herein. In addition, various components, modules, etc., described herein may be implemented as one or more software modules, hardware modules, special-purpose hardware (e.g., application specific hardware, application specific integrated circuits (ASICs), embedded controllers, hardwired circuitry, etc.), or some combination of these.

FIG. 1 shows a computer system 102 and a computing device 104 connected to a network 106. Computer system 102 represents generally any computing device or group of computing devices capable of sending network requests and data to, and otherwise communicating with, computing device 104 via network 106. In embodiments, computer system 102 may be or include a printer, a printer server, and/or any other computing device.

Computing device 104 represents generally any computing device or group of computing devices capable of sending network requests and data to, and otherwise communicating with, computer system 102. In embodiments, computing device 104 may be or include a desktop computer, laptop computer, mobile computing device, smart phone tablet computer, and/or any other computing device.

In an example, a print job 108 is received at computer system 102 from or at the direction of computing device 104. The print job 108 includes a first plot 110 to be printed the first side of a media, and a second plot 112 that is associated with the first plot and is to be printed on the second side of the media in registration with the first plot 110.

Computer system 102 causes printing, on the first side of the media, of the first plot and a fiducial that is printed a known distance from the first plot and that includes an identifier for the second plot. In examples, the identifier may be in the form of a barcode. Examples of barcodes include, but are not limited to, linear barcodes ("one dimensional" or "1D" barcodes), rectangles, dots, hexagons and other geometric patterns in two dimensions ("two dimensional" or "2D" barcodes), and barcodes in which a third dimension (such as a color variation or a tactile variation) is considered in addition to the geometric patterns present in a 2D barcode ("three dimensional" or "3D" barcodes). Examples of 1D barcodes are EAN and UCC barcodes. Examples of 2D barcodes are OR codes, GSI Databars, PDF 417s, data matrixes, maxicodes, Microsoft® tags and Aztec codes. In another example, the identifier may be in the form a character string.

In an example, the identifier may be a pointer to a memory location for the second plot, or a metadata tag or other tag with an address to a memory location for the second plot. In another example, the identifier may indirectly identify the second plot by providing a reference to the first plot, which first plot is associated with the second plot via a lookup table stored in a memory accessible to computer system 102.

Computer system 102 detects the identifier via a sensor, and measures a distance to the fiducial to determine a reference for printing the second plot on the second side of the media. Responsive to the detection and the measurement, computer system 102 causes printing of the second plot on the second side in registration with the first plot. In an embodiment, the distance to the fiducial is measured by the same sensor that detects the identifier. In an embodiment, the same sensor that detects the identifier and measures a distance to the fiducial is a sensor that is also utilized by printer to measure media advances during printing. In another embodiment, the distance to the fiducial is measured by a sensor other than the sensor that detects the identifier.

The functions and operations described with respect to computer system 102 may be implemented as a computer-readable storage medium containing instructions executed by a processor (e.g., processor 114) and stored in a memory (e.g., memory 116). In a given implementation, processor 114 may represent multiple processors, and memory 116 may represent multiple memories. Processor 114 represents generally any instruction execution system, such as a computer/processor based system or an ASIC, a computer, or other system that can fetch or obtain instructions or logic stored in memory 116 and execute the instructions or logic contained therein. Memory 116 represents generally any memory configured to store program instructions and other data.

Figure 2:
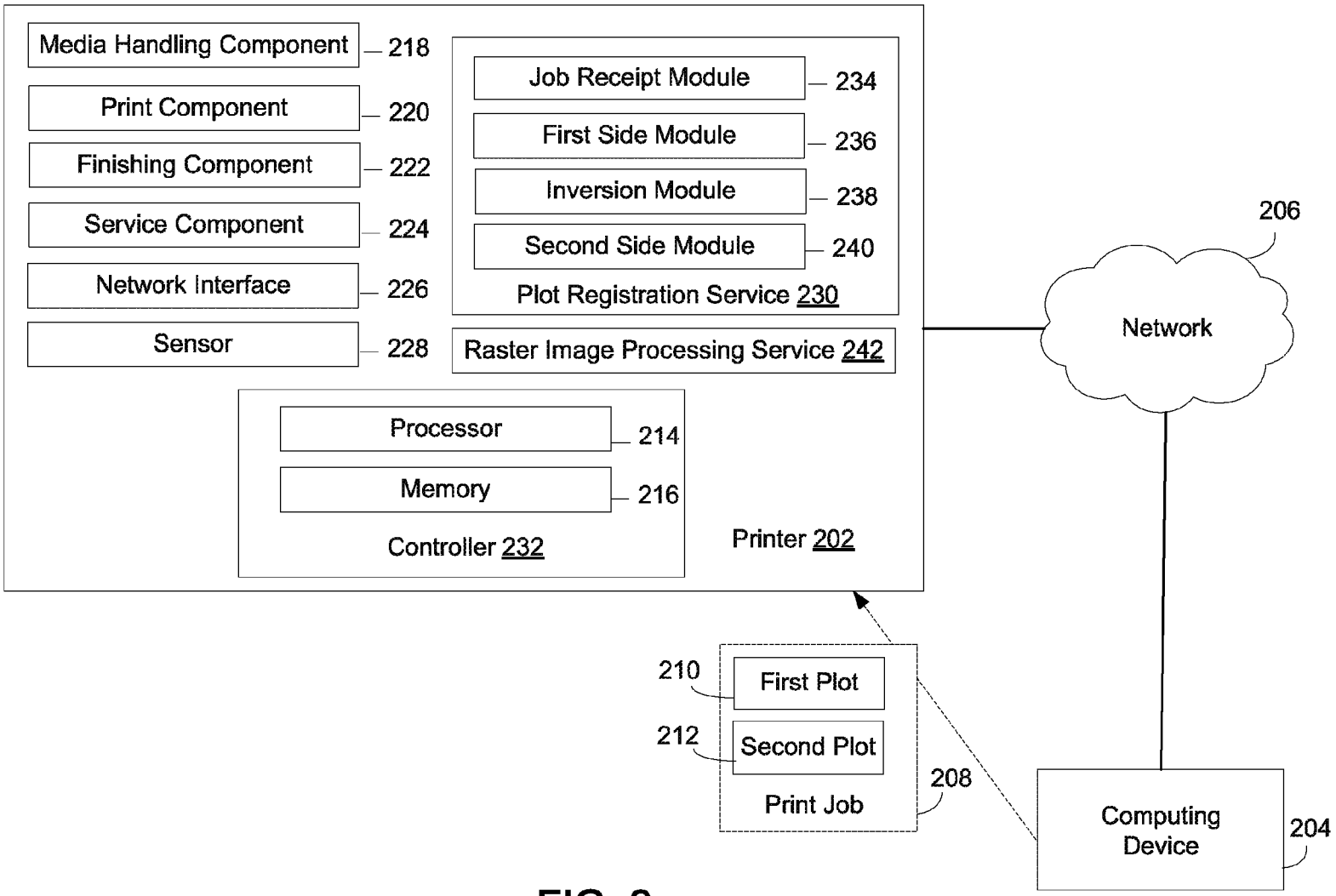

FIG. 2 is a block diagram that includes a system according to various embodiments. FIG. 2 includes particular components, modules, etc., according to various embodiments. However, in different embodiments, more, fewer, and/or other components, modules, arrangements of components/modules, etc., may be used according to the teachings described herein. In addition, various components, modules, etc., described herein may be implemented as one or more software modules, hardware modules, special-purpose hardware (e.g., application specific hardware, ASICs, embedded controllers, hardwired circuitry, etc.), or some combination of these.

FIG. 2 shows printer 202 and computing device 204 connected to a network 206. Printer 202 represents generally any computing device operable to receive and process responses to requests to print content and to produce printed output. In embodiments printer 202 may be an inkjet, laser, piezoelectric, or any other type of electronic printing device. Printer 202 is capable of receiving messages, including but not limited to print jobs, from computing device 204 over network 206.

Computing device 204 represents generally any computing device or group of computing devices capable of sending networks requests and data, including print jobs, to and otherwise communicating with, printer 202. In embodiments, computing device 204 may be or include a desktop computer, laptop computer, mobile computing device, smart phone tablet computer, and/or any other computing device.

Printer 202 is shown to include a media handling component 218, print component 220, finishing component 222, service component 224, network interface 226, sensor 228, plot registration service 230, and controller 232. Media handling component 218 represents generally any combination of hardware and programming capable of transporting media through printer 202. Print component 220 represents generally any combination of elements capable of being utilized to form desired plots on a media. Finishing component 222 represents generally any combination of hardware and programming capable of performing a finishing operation on media. Such finishing operations may include cutting, folding, laminating or any other action that affects the physical nature of the print medium. Service component 224 represents generally any combination of elements capable of being utilized to service print component 220. Where, for example, print component 220 includes a printhead, service component 224 may be configured to function as a printhead wiper, priming station, and/or spittoon. Network interface 226 represents generally any combination of hardware and programming configured for electronically connecting the printer 202 to network 206. Sensor 228 represents generally any device capable of detecting a physical stimulus, e.g., light or sound, to measure distances and to detect markings and/or artifacts on a media. In examples, sensor 228 may be an optical sensor, an acoustic sensor or other type of sensor. Plot registration service 230 is configured to cause printing of associated plots in registration on a first and a second side of a media, and includes a job receipt module 234, a first side module 236, an inversion module 238, and a second side module 240.

In the example of FIG. 2, job receipt module 234 receives a print job 208 from or at the direction of computing device 204. The print job 208 includes a first plot 210 to be printed the first side of a media, and a second plot 212 to be printed on a second side of the media in registration with the first plot 210. In examples, the print job may be received as a document or a file, and in a variety of document and/or file formats. In an example, the print job may be received at printer 202 via a networking protocol, including but not limited to Transmission Control Protocol/Internet Protocol ("TCP/IP"), HyperText Transfer Protocol ("HTTP"), Simple Mail Transfer Protocol ("SMTP"), Extensible Messaging and Presence Protocol ("XMPP") and/or Session Initiation Protocol ("SIP"). The print job may be received at the printer 202 via a local area network ("LAN"), or via the Internet, an intranet, or another wide area network (WAN"). In an example, the print job may be received from another computing device or a media via a proximity wireless protocol or personal area network ("PAN"), such as a Bluetooth™, WiFi™, or other near field communication connection. In another example, printer 202 may be a web-enabled printer and the print job 208 is received at the printer 202 via the Internet or an intranet. In yet another example, the print job 208 may be a print job received at printer 202 via a storage media (e.g., a USB flash drive, CD, DVD) or other memory device that can be physically connected (e.g., removably connected via a USB port) or wirelessly connected to printer 202, rather than from computing device 204.

First side module 236 causes printing of the first plot 210 and a fiducial on the first side of the media. Moving to the example of FIG. 3A, the fiducial 346 is in the form of a rectangular feature printed a known distance 350 from the first plot 210, and includes an identifier 352 for the second plot 212. The known distance 350 between the fiducial 346 and the first plot 210 is a distance measured approximately parallel to the media process direction 354. In another example of printing a first plot and a fiducial on a first side of the media depicted at FIG. 3B, the width 358 of the rectangular fiducial 346 is substantially the same as the width 360 of the first plot 210. In the example of FIG. 3B the known distance 350 between the fiducial 346 and the first plot 210 is a distance measured approximately perpendicular to the media process direction 354.

Figure 3A:
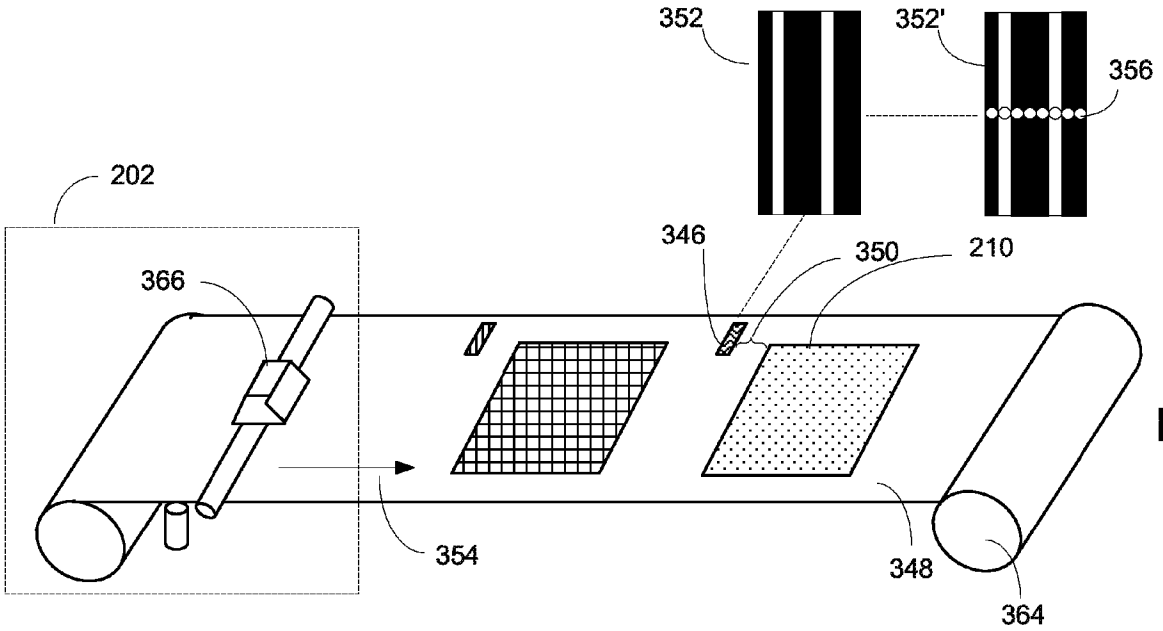
FIGS. 3A and 3B are examples of printing a first plot and a fiducial with an identifier on a first side of media, according to various embodiments.
Figure 3B:
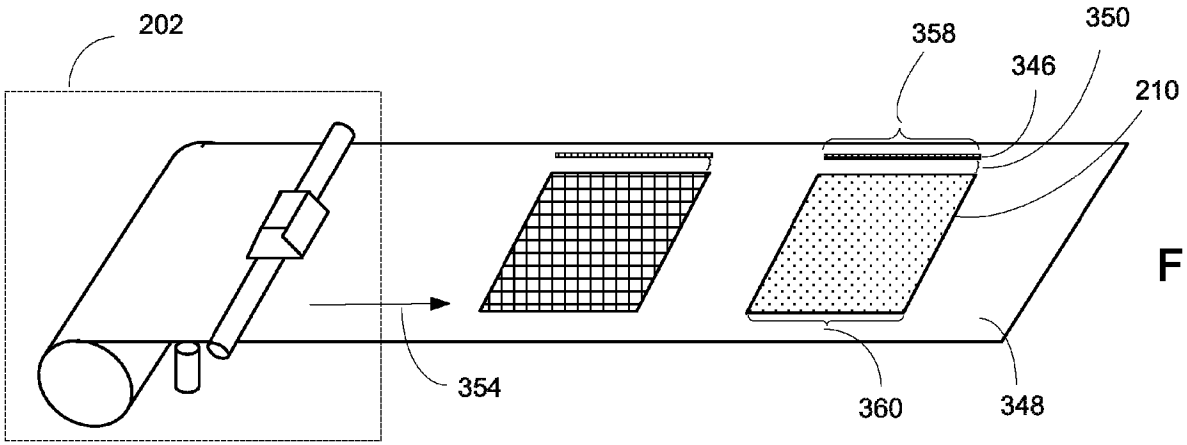

In the example of FIG. 3A the identifier 352 is in the form of a 1D barcode. As illustrated in a second view of the example barcode at 352', the barcode is configured such that eight sensor readings 356 (shown as eight circles) across the width of the barcode, would read black in the barcode as a binary code "1" and the white in the barcode as a binary code "0", to form the binary number "1011011." In this example, the binary number "1011011" is a pointer to a memory location for the second plot 212 to be printed on a second side of the media. In another example the identifier could include a metadata tag or other tag with an address to a memory location for the second plot 212.

Returning to FIG. 2, in an example identifier 352 (FIG. 3A) that is printed upon the first side of the media 348 (FIG. 3A) is generated by first side module 236 at printer 22. In another example, the identifier 352 may be generated by a raster image processing service 254 at printer 202. In yet another example, e.g., an embodiment in which the print job 208 undergoes raster image processing at a computing device distinct from printer 202, the identifier 352 may be generated at a computing device that is distinct from printer 202.

Inversion module 238 causes an inversion of the media after printing of the first plot on the first side of the media. Returning to the example of FIG. 3A, causing an inversion of the media includes causing the media to be taken up on a take-up device 364 during printing of the first plot. Moving to FIGS. 4A and 4B, the take-up device 364 is then positioned to supply the media during printing of the second plot 212. As a result of the inversion, the same mechanism 366 (e.g., a printhead) that prints the first plot 210 and the fiducial 346 on the first side of the media 348 (FIG. 3A) can be used to print the second plot 212 on the second side of the media 362.

After the inversion of the media the second side 362 is in a position to be printed upon by printer 202, and the fiducial 346 is exposed to a sensor 228 as the media is advanced by the printer 202. The second side module 240 (FIG. 2) detects, via sensor 228, the identifier 352 (FIG. 3A) included within fiducial 346 that was printed on the first side 348 of the media. The information provided by the identifier 352 is utilized to identify the second plot 212 to be printed on the second side 362 of the media.

Figure 5A:
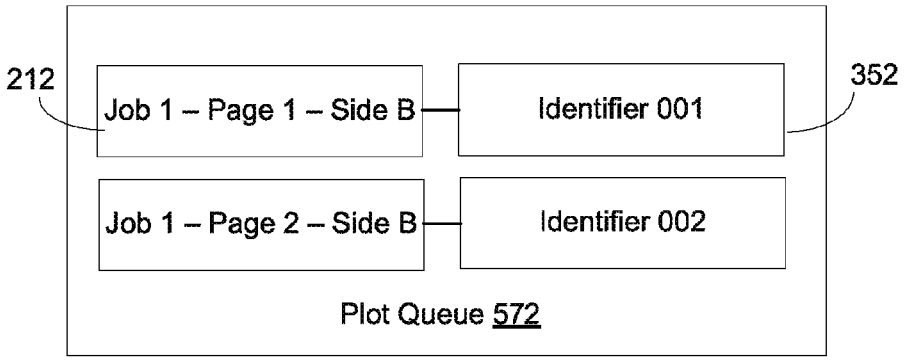
FIGS. 5A, 5B and 6A are example plot queues located within printer memory, according to various embodiments.

FIG. 5A is a block diagram of a plot queue 572 for print job 208 stored in printer internal memory 216 (FIG. 2). The identifier 352 is associated in memory with plot "Job 1-Page 1-Side B." In this example, the second side module 240 (FIG. 2B) discerns, after sensor 228 detects the identifier 352, that "Job 1-Page 1-Side B" is the second plot 212 to be printed on the second side 362 of the media in registration with the first plot 210.

Figure 5B:
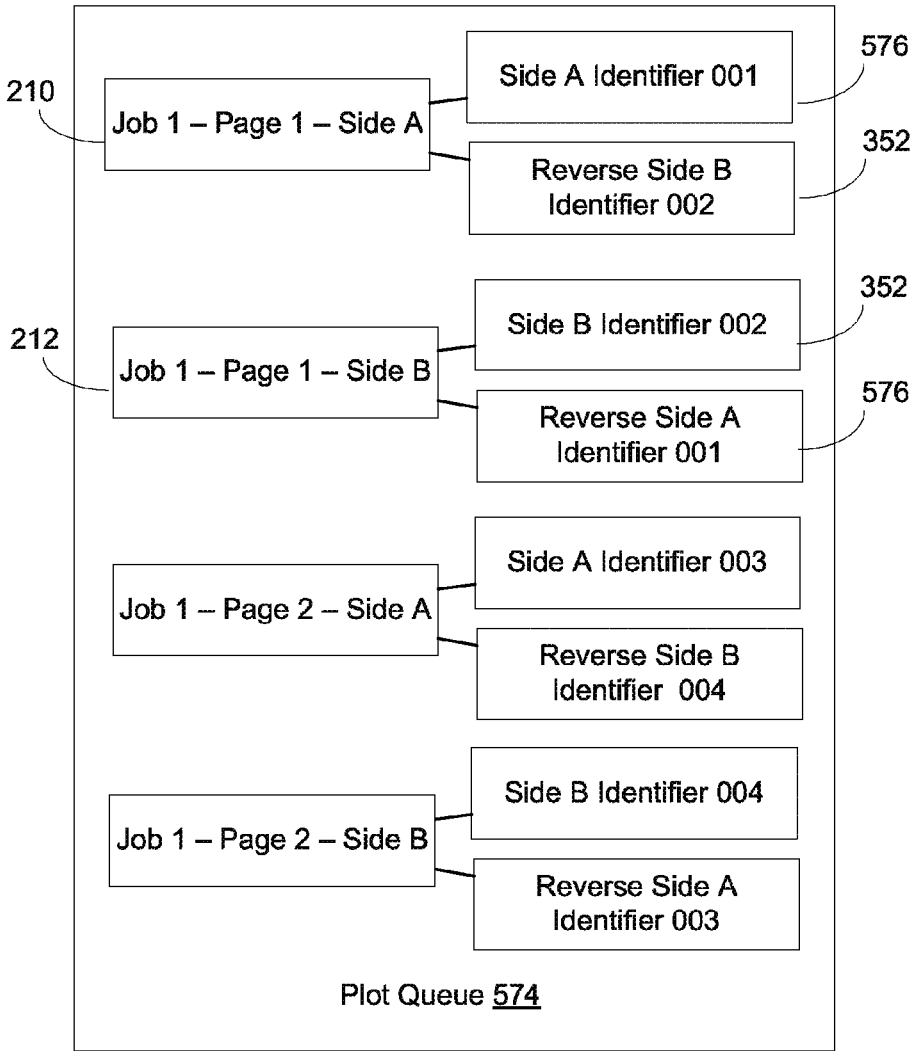

FIG. 5B provides another example of a plot queue 574 for print job 208 (FIG. 2) in printer memory. In the example of FIG. 5B we assume that the fiducial 346 that is printed a known distance 350 (FIG. 3B) from the first plot 210 on the first side of the media 348 contains two identifiers. The first identifier 576 "Identifier 001" points to, labels, or otherwise identifies the first plot 210 ("Job 1-Page 1-Side A"). The second identifier 352 "Identifier 002" points to, labels, or otherwise identifies "Job 1-Page 1-Side B" as the second plot 212 to appear on the second side 362 of the media, in registration with the first plot 210.

Figure 4A:
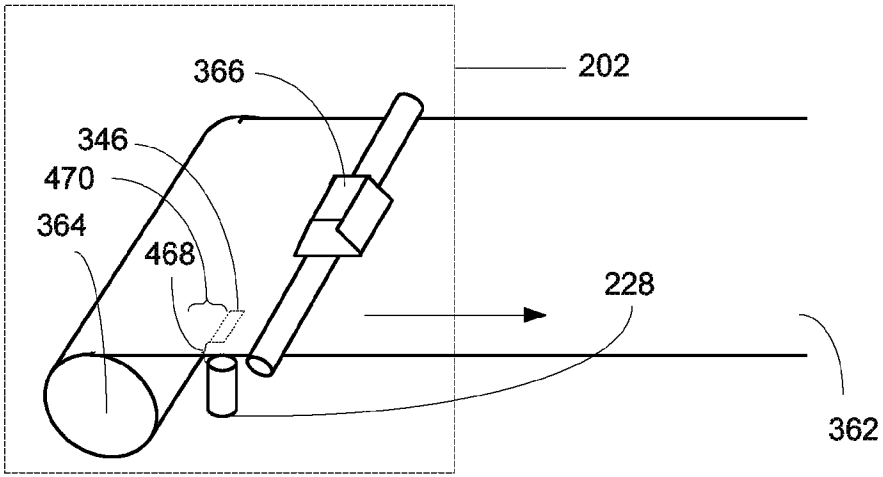
FIGS. 4A and 4B are examples of detecting an identifier via a sensor and measuring a distance to a fiducial to print a second plot in registration with a first plot, according to various embodiments.
Figure 4B:
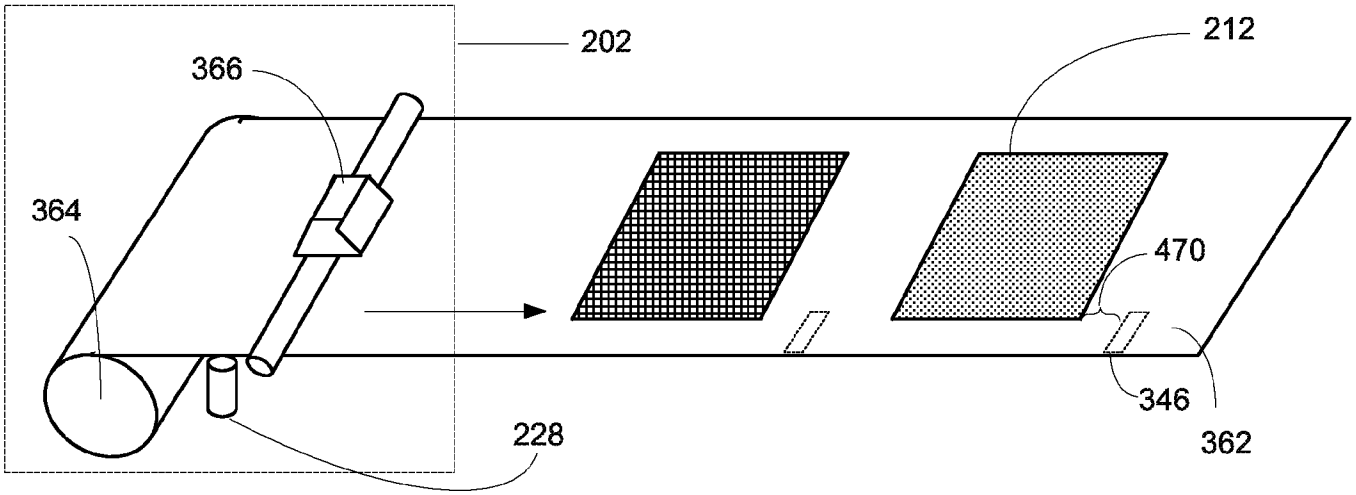
Figure 6A:
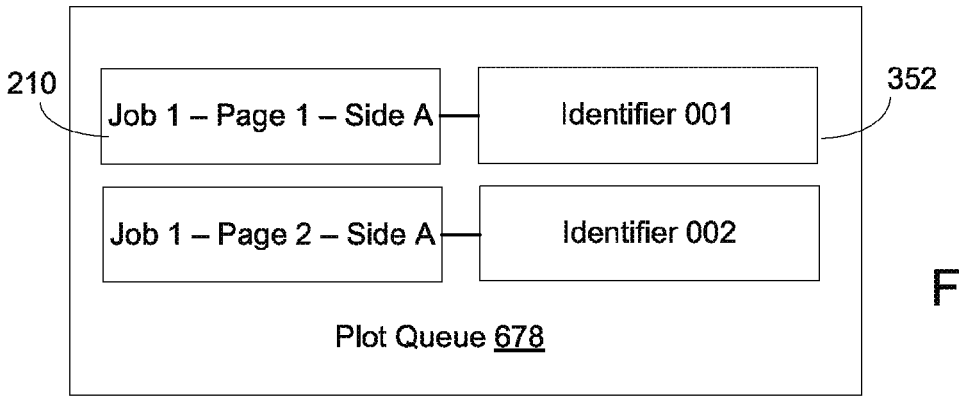
Figure 6B:
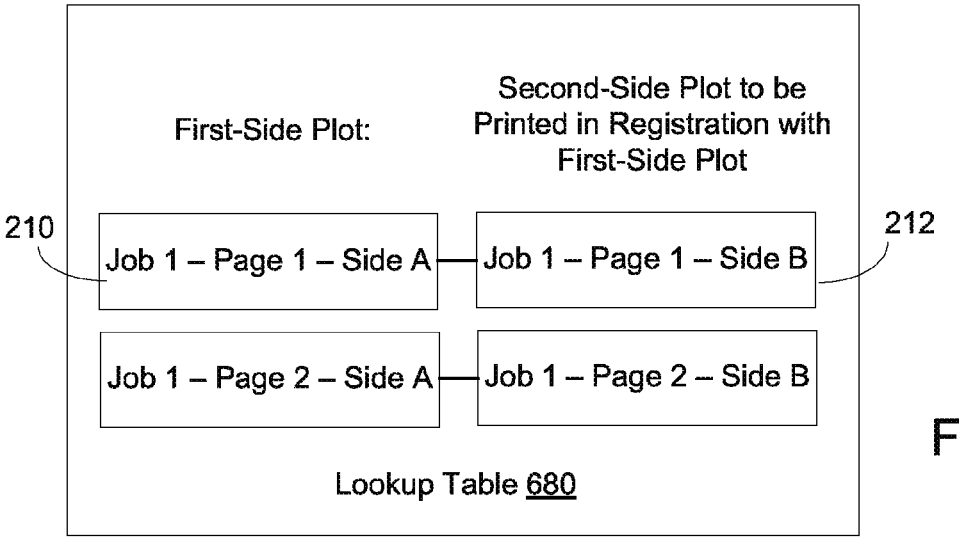
FIG. 6B is an example lookup table located within printer memory, according to various embodiments.

FIG. 6A provides another example of a plot queue 678 for print job 208 (FIG. 2) in printer memory. In this example, the identifier 352 indirectly identifies "Job 1-Page 1-Side B" as the second plot 212 to be printed on the second side 362 (FIG. 4B) of the media in registration with first plot 210 printed on the first side 348 (FIG. 4A). When detected by the sensor 228, identifier 352 provides a reference to the first plot 210 ("Job 1-Page 1-Side A") at the plot queue 678 stored in printer memory 216 (FIG. 2). The second plot 212 is then associated with the first plot 210 via a lookup table 680 that is also stored in memory 216 and is accessible to the plot registration service 230. In this manner identifier 352 may point to or contain a tag for first plot 210, and still serve as an identifier for the second plot 212.

Returning to FIGS. 4A and 4B, second side module 240 (FIG. 2) additionally measures a distance 468 to the fiducial 346 to discern a reference 470 for printing the second plot 212. In an example, this distance is measured by the same sensor 228 that is used to detect the identifier 352. In another example, the distance may be measured by a second sensor. In response to the detection of the identifier 352 and the measurement of the distance 468 to discern the reference 470, the second plot 212 is caused to print on the second side 362 of the media in registration with the first plot 210 (FIG. 3A).

It should be noted that in some embodiments, the printing of the second plot is initiated or triggered upon the detection of the second identifier 352 by the sensor 228 and the measurement of a distance 468 to the fiducial 346 to discern a reference 470 for printing. In other embodiments, however, one or more additional conditions precedent, including, but not limited to a condition precedent relating to the media, is confirmed as met before the printing of the second plot 212 on the second side 362 occurs. In one example, plot registration service 230 may be configured to ensure the following media conditions precedent are net before printing of the second plot 212 on the second side 362 will occur: "loaded media width is sufficient", "loaded media length is sufficient", and/or "loaded media type matches that specified in the job settings." In an embodiment, notwithstanding the completion of the detection and measurement steps, printing of the second plot 212 on the second side 362 is placed on hold in a job queue until the media conditions precedent are met. In other embodiments, fewer, more, or different conditions precedent may be confirmed.

Returning to FIG. 2, printer 202 is shown to include a controller 232. As used in this specification, controller 232 represents generally any combination of elements capable of coordinating the operation of components 218, 220, 222, 224, 226, 228, 234, 236, 238, 240, and 242. In a given implementation, the controller 232 includes a processor 214 and a memory 216. The processor 214 may represent multiple processors, and the memory 216 may represent multiple memories. Processor 214 represents generally any instruction execution system, such as a computer/processor based system or an ASIC, a computer, or other system that can fetch or obtain instructions or logic stored in memory 216 and execute the instructions or logic contained therein. Memory 216 represents generally any memory configured to store program instructions and other data.

Figure 7:
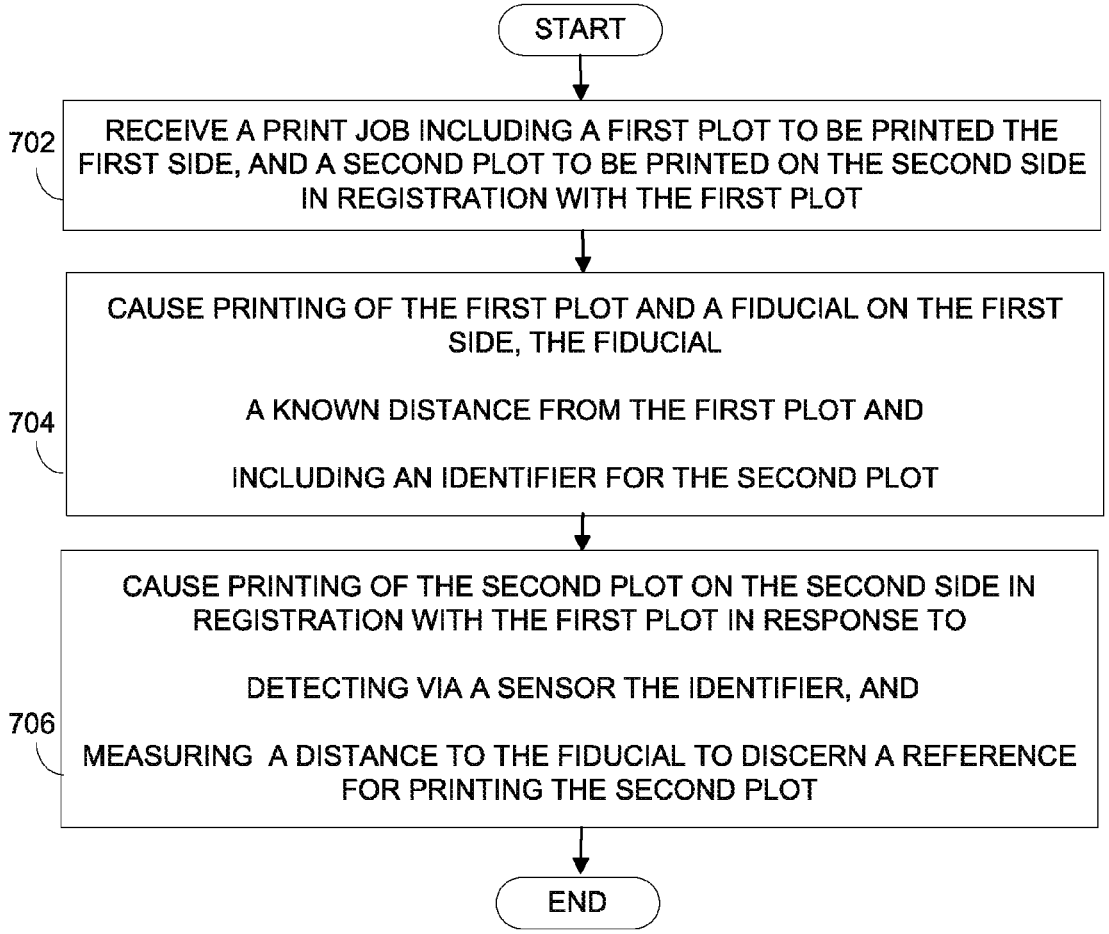
FIGS. 7 and 8 are flow diagrams depicting steps taken to implement various embodiments.

FIG. 7 is a flow diagram of operation in a system according to various embodiments. In discussing FIG. 7, reference may be made to the diagrams of FIGS. 1-6 to provide contextual examples. Implementation, however, is not limited to those examples. Starting with FIG. 7, a print job is received. The print job includes a first plot to be printed the first side, and a second plot to be printed on the second side in registration with the first plot. (block 702). Referring back to FIG. 2 job receipt module 234 may be responsible for implementing block 702.

Continuing with the flow diagram of FIG. 7, the first plot and a fiducial are caused to print on the first side. The fiducial is a known distance from the first plot, and includes an identifier for the second plot (block 704). Referring back to FIG. 2, first side module 236 may be responsible for implementing block 704.

Continuing with the flow diagram of FIG. 7, the second plot is caused to print on the second side in registration with the first plot. The printing is caused in response to detecting the identifier via a sensor, and measuring a distance to the fiducial to discern a reference for printing the second plot (block 706). Referring back to FIG. 2, second side module 240 may be responsible for implementing block 706.

Figure 8:
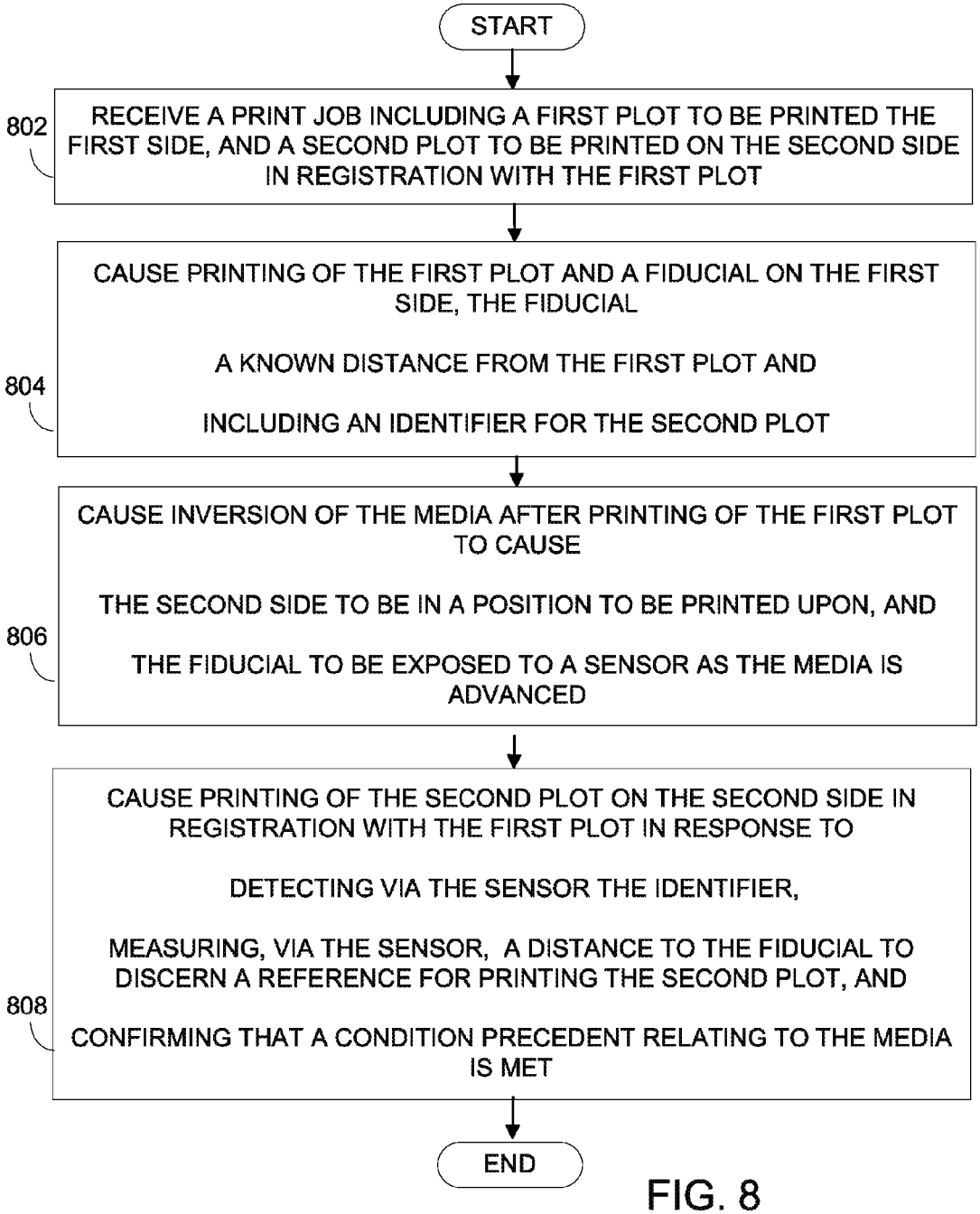

FIG. 8 is another flow diagram of operation in a system according to various embodiments. In discussing FIG. 8, reference may be made to the diagrams of FIGS. 1-6 to provide contextual examples. Implementation, however, is not limited to those examples. Starting with FIG. 8, a print job, including a first plot to be printed the first side and a second plot to be printed on the second side in registration with the first plot, is received (block 802). Referring back to FIG. 2, job receipt module 234 may be responsible for implementing block 802.

Continuing with the flow diagram of FIG. 8, the first plot and a fiducial are caused to print on the first side. The fiducial is a known distance from the first plot, and includes an identifier for the second plot (block 804). Referring back to FIG. 2, first side module 236 may be responsible for implementing block 804.

Continuing with the flow diagram of FIG. 8, an inversion of the media after printing of the first plot is caused. The inversion of the media causes the second side to be in a position to be printed upon. The inversion further causes the fiducial to be in a position to be exposed to a sensor as the media is advanced (block 808). Referring back to FIG. 2, inversion module 238 may be responsible for implementing block 806.

Continuing with the flow diagram of FIG. 8, printing of the second plot is caused on the second side such that the second plot is in registration with the first plot. The printing of the second plot is caused in response to a detection, via the sensor, of the identifier, a measurement, via the sensor, of a distance to the fiducial, and a confirmation that a condition precedent relating to the media is met. The measurement of the fiducial is to discern a reference for printing the second plot (block 808). Referring back to FIG. 2 second side module 240 may be responsible for implementing block 806.

Although the flow diagrams of FIGS. 7 and 8 show specific orders of execution, the orders of execution may differ from that which is depicted. For example, the order of execution of two or more blocks may be scrambled relative to the order shown. Also, two or more blocks shown in succession may be executed concurrently or with partial concurrence. All such variations are within the scope of the present disclosure.

Various modifications may be made to the disclosed embodiments and implementations without departing from their scope. Therefore, the illustrations and examples herein should be construed in an illustrative, and not a restrictive, sense.

What is claimed is:

1. A method to print associated plots in registration on first and second sides of a media, comprising:
   - receiving a print job including a first plot to be printed the first side, and a second plot to be printed on the second side in registration with the first plot;
   - causing printing of the first plot and a fiducial mark on the first side, the fiducial mark
     - being a known distance from the first plot, and
     - including an identifier, wherein the identifier is data that indicates which of a plurality of plots in a memory location is the second plot to be printed on the second side;
   - causing printing of the second plot on the second side in registration with the first plot in response to
     - detecting via a sensor the identifier, and
     - measuring a distance to the fiducial mark to discern a reference for printing the second plot.

2. The method of claim 1, wherein the distance to the fiducial mark is measured by the sensor.

3. The method of claim 1, wherein the distance to the fiducial mark is measured by a sensor other than the sensor that detects the identifier.

4. The method of claim 1, wherein the identifier comprises a barcode.

5. The method of claim 1, wherein the identifier is an identifier generated at a computing device distinct from a printer device and an internal processor of the printer device.

6. The method of claim 1, wherein the identifier is an identifier generated at a printer.

7. The method of claim 1, wherein a width of the fiducial mark is substantially the same as a width of the first plot.

8. The method of claim 1, wherein the identifier comprises a pointer to the memory location for the second plot.

9. The method of claim 1, wherein the identifier comprises a tag with an address to the memory location for the second plot.

10. The method of claim 1, wherein the identifier indirectly identifies the second plot via a lookup table.

11. The method of claim 1, wherein a same print mechanism prints the first and second plots.

12. The method of claim 1, wherein causing printing of the second plot on the second side further comprises confirming that a condition precedent relating to the media is met.

13. The method of claim 1, further comprising causing inversion of the media after printing of the first plot to cause
   - the second side to be in a position to be printed upon, and
   - the fiducial mark to be exposed to a sensor as the media is advanced.

14. The method of claim 13, wherein causing inversion of the media comprises:
   - causing the media to be taken up on a take-up device during printing of the first plot; and
   - causing positioning of the take-up device to supply the media during printing of the second plot.

15. A system to print associated plots in registration on first and second sides of a media, comprising:
   - a receipt module to receive a print job including a first plot to be printed the first side, and a second plot to be printed on the second side in registration with the first plot;

a first side module to cause printing of the first plot and a fiducial mark on the first side, the fiducial mark
being a known distance from the first plot, and
including an identifier, wherein the identifier is data that indicates which of a plurality of plots in a memory location is the second plot to be printed on the second side;

a second side module to cause printing of the second plot on the second side in registration with the first plot in response to
detecting, via a sensor, the identifier, and
measuring a distance to the fiducial mark to discern a reference for printing the second plot.

16. The system of claim 15, wherein the identifier comprises a two dimensional barcode.

17. The system of claim 15, wherein the identifier provides the memory location for the second plot.

18. The system of claim 15, wherein the identifier indirectly identifies the second plot via a lookup table.

19. The system of claim 15, further comprising an inversion module to cause inversion of the media after printing of the first plot to cause
the second side to be in a position to be printed upon, and
the fiducial mark to be exposed to the sensor as the media is advanced.

20. A non-transitory computer-readable storage medium containing instructions to print associated plots in registration on first and second sides of a media, the instructions when executed by a processor causing the processor to:

receive a print job including a first plot to be printed the first side, and a second plot to be printed on the second side in registration with the first plot;

cause printing of the first plot and a fiducial mark on the first side, the fiducial mark
being a known distance from the first plot, and
including an identifier, wherein the identifier is data that indicates which of a plurality of plots in a memory location is the second plot to be printed on the second side;

cause inversion of the media after printing of the first plot to cause
the second side to be in a position to be printed upon, and
the fiducial mark to be exposed to a sensor as the media is advanced;

cause printing of the second plot on the second side in registration with the first plot in response to
detecting, via the sensor, the identifier,
measuring, via the sensor, a distance to the fiducial mark to discern a reference for printing the second plot, and
confirming that a condition precedent relating to the media is met.

* * * * *